United States Patent [19]

O'Connor

[11] 4,287,240

[45] Sep. 1, 1981

[54] COATING APPARATUS PROVIDED WITH A PROTECTIVE SHIELD

[75] Inventor: Thomas R. O'Connor, Webster, N.Y.

[73] Assignee: Eastman Kodak Company, Rochester, N.Y.

[21] Appl. No.: 139,506

[22] Filed: Apr. 11, 1980

[51] Int. Cl.[3] ..... B05C 3/02; B05C 11/00; B05D 3/40

[52] U.S. Cl. ..... 427/402; 118/325; 118/326; 118/407; 118/412; 427/420; 430/935

[58] Field of Search ..... 118/324, 325, DIG. 4, 118/407, 412, 326; 427/420, 402, 411, 445; 430/935

[56] References Cited

U.S. PATENT DOCUMENTS

| | | | |
|---|---|---|---|
| 3,404,025 | 10/1968 | Wotten | 427/420 X |
| 3,500,741 | 3/1970 | Bok | 118/326 |
| 3,508,947 | 4/1970 | Hughes . | |
| 3,632,374 | 1/1972 | Greiller . | |
| 3,710,758 | 1/1973 | Hoff | 427/420 X |
| 4,023,472 | 5/1977 | Grunder | 98/40 D |
| 4,061,082 | 12/1977 | Shuler | 98/40 DL |
| 4,064,832 | 12/1977 | Chujo et al. | 118/326 |
| 4,075,976 | 2/1978 | Clayton | 118/32 X |
| 4,113,903 | 9/1978 | Choinski | 427/420 |
| 4,170,930 | 10/1979 | Lind | 98/40 D |

FOREIGN PATENT DOCUMENTS

| | | | |
|---|---|---|---|
| 1075979 | 7/1967 | United Kingdom | 427/420 |
| 1559701 | 1/1980 | United Kingdom . | |

OTHER PUBLICATIONS

Research Disclosure, 1/1980, Industrial Opportunities Ltd., Homewell, Havant, Hampshire, P09 1EF, UK.

"Industrial Electrostatic Percipitation", H. J. White, Addison-Wesley Publishing Co. Inc., 1963, pp. 262-272.

Electrostatic Percipitator Manual, Chp. II, pp. 45.8-46.3, The Melluaine Co., 1977.

Electrostatic Percipitation, Oglesby et al., Marcel Dekker, Inc., N.Y., N.Y., 1978, pp. 250-255.

The Use of Damping Screens for the Reduction of Wind-Tunnel Turbulence, H. L. Dryden, J. of Aero. Science, vol. 4, No. 4, pp. 221-228, 1947.

*Primary Examiner*—Shrive P. Beck

*Attorney, Agent, or Firm*—A. P. Lorenzo

[57] ABSTRACT

Coating apparatus for carrying out a process of coating in which one or more layers of coating composition are applied to the surface of an object, such as a continuous web or discrete sections of sheet material, by advancing the object through a coating zone in which a flow of coating composition is applied thereto, for example, bead coating or curtain coating apparatus, is provided with a shield to protect the flow of coating composition against disturbance by ambient air currents. The shield is formed of a foraminous material, such as screening or perforated plate material, which functions to diffuse air currents impinging thereon so that their velocity is decreased, with a resulting decrease in their ability to disturb the flow of coating composition. Particular advantage is achieved in using the shield in processes for coating photographic materials, especially in high speed curtain coating operations involving a substantial height of free fall, and in bead coating operations employing a slide hopper where ambient air currents give rise to a problem of differential evaporation of coating composition on the slide surface.

32 Claims, 4 Drawing Figures

COATING APPARATUS PROVIDED WITH A PROTECTIVE SHIELD

FIELD OF THE INVENTION

This invention relates in general to the art of coating and in particular to an improved method and apparatus for carrying out a process of coating in which one or more layers of coating composition are applied to the surface of an object by advancing the object through a coating zone in which a flow of coating composition is applied thereto, for example, a process of bead coating or a process of curtain coating. More specifically, this invention relates to an improved coating method and apparatus in which the flow of coating composition is effectively protected against disturbance by ambient air currents.

BACKGROUND OF THE INVENTION

Among the many known methods of coating, one which is assuming increasing commercial importance is the method known as curtain coating. This method is characterized by the formation of a free-falling curtain of liquid coating composition. The object to be coated, for example a continuous web, or a series of discrete sheets carried by a conveyor belt or similar conveying means, is advanced through a coating zone and the coating apparatus is positioned within the coating zone above the path of the moving object. The falling curtain extends transversely of the path and impinges on the moving object to form the desired coating.

Many different types of apparatus are known for use in forming the free-falling curtain. For example, the curtain can be formed by use of apparatus utilizing an overflow weir, or by apparatus in which the coating composition is extruded from an elongated discharge slot, or by use of a slide hopper, or by use of a slide-extrusion hopper.

Regardless of the type of apparatus utilized to generate the free-falling curtain, curtain coating methods have in common the problem that the curtain is susceptible to disturbance by ambient air currents. The degree to which the curtain is susceptible to such disturbance is dependent, in part, on the height of free fall, with the susceptibility to disturbance increasing in more or less direct proportion to such height. In many instances, it is desirable that the height of free fall be relatively great, in order to provide a relatively high impingement velocity, and where the height is great the problem of disturbance is especially acute. For example, when an object to be coated, such as a continuous web, is advanced through the coating zone at high speeds, the barrier layer of air that it carries on its surface necessitates a substantial impingement velocity to achieve good coating results, and thereby necessitates a substantial height of free fall. Many other factors, in addition to the height of free fall, interact to determine the extent to which the curtain is susceptible to disturbance by ambient air currents; for example, important factors include the mass flow rate, the physical properties of the coating composition such as viscosity and surface tension, and the design of the coating apparatus.

In some coating operations, disturbance of the free-falling curtain by ambient air currents is not a serious problem. However, in other coating operations, such as the use of curtain coating in the coating of photographic materials, which require extremely precise conditions, it is a very serious problem indeed. Curtain coating is a very useful method for the coating of photographic films and papers, being well adapted to the application of both radiation-sensitive and non-radiation-sensitive layers. As described in Greiller, U.S. Pat. No. 3,632,374 issued Jan. 4, 1972, curtain coating can be used as a single-layer coating method in the manufacture of photographic materials. As described in Hughes, U.S. Pat. No. 3,508,947 issued Apr. 28, 1970, curtain coating is especially advantageous as a method of simultaneous multi-layer coating in which two or more layers of coating composition are simultaneously applied in the manufacture of photographic materials. Whether the curtain coating method is employed in the single-layer mode or in the multi-layer mode, the manufacture of photographic materials requires exacting conditions, so that disturbance of the free-falling curtain by ambient air currents is of great concern. To appreciate the extent of this concern, it should be realized that the mere opening and closing of a door to the coating room, or the movement of personnel in the vicinity of the coating apparatus, can cause severe curtain movement.

U.S. Pat. No. 3,632,374 to Greiller discusses the problem of selecting the height of free-fall in a curtain coating process as follows:

> "In the practice of this invention, the height of the free-falling curtain, i.e., the distance over which free fall occurs, is selected to facilitate attainment of the desired objective of applying an extremely thin coating with extremely uniform thickness. In selecting the optimum height, an important criterion is that the height be made as small as is practical because the longer the free-falling curtain the more susceptible it is to being affected by ambient air currents causing flutter of the curtain and resultant non-uniformity in the product. However, the height must also be selected in accordance with the requirement that the free-falling curtain have adequate momentum at impingement to effectively penetrate or displace the air barrier and adhere to the moving support. To this end, it is desirable that the coating apparatus provide for adjustment of the height of free fall over a substantial range. The air barrier will vary with such factors as the character of the surface to be coated, the effectiveness of mechanical means utilized to remove entrained air, and the velocity at which the support is advanced. Also, since momentum is the product of velocity and mass, if the flow rate of the coating composition is reduced the height of free fall should, in general, be increased so as to increase the impingement velocity and give the free-falling curtain sufficient momentum to penetrate the air barrier. Under typical conditions in the practice of this invention, the height of the free-falling curtain will be in the range from about 5 to about 20 centimeters, but operation at smaller or greater heights than this is also fully within the contemplation of this invention."

It is well known to equip curtain coating apparatus with a shield to protect the free-falling curtain from disturbance by ambient air currents. For example, both U.S. Pat. No. 3,632,374 to Greiller and U.S. Pat. No. 3,508,947 to Hughes describe the use of a shield which is attached to the coating hopper and extends into close proximity with the path along which the object to be coated is advanced. Such shields are helpful, to a very limited extent, in protecting the free-falling curtain from disturbance by ambient air currents. However, they are much less effective than is desirable for optimum coating performance, and disturbance of the free-falling curtain remains a serious problem which hinders the successful employment of curtain coating in precision coating operations, such as photographic coating.

In bead coating operations, which at the present time are very widely used in the manufacture of photographic materials, disturbance by ambient air currents is also a serious problem. Bead coating is carried out by forming a bead of coating composition which is maintained in bridging relationship between the coating hopper and a surface of the web to be coated. Movement of the web across and in contact with the bead results in deposition of a layer of coating composition on the web. Bead coating is useful both as a single layer coating method and as a method in which the bead is formed from a plurality of flowing layers to thereby carry out simultaneous multi-layer coating (See, for example, U.S. Pat. Nos. 2,681,294, 2,761,417, 2,761,418, 2,761,419 and 2,761,791). A particularly useful type of coating hopper, for carrying out a bead coating operation, is the slide hopper. Such hoppers comprise one or more slide surfaces down which a layer of coating composition is flowed in forming a coating bead. However, a serious difficulty occurs in the use of slide hoppers in that the coating composition flowing down the slide surface is exposed to contact with ambient air currents. This can result in differential evaporation of the liquid medium from the coating composition as it travels on the slide surface and, as a consequence thereof, the formation of mottle or other defects in the coating.

Slide hoppers are also advantageously employed in both single layer and multiple layer curtain coating operations. In these processes, differential evaporation on the slide surface is also a significant problem. Accordingly, it is desirable in such processes to protect the coating composition against disturbance by ambient air currents both when it is travelling down the slide surface and when it is undergoing free fall.

It is toward the objective of providing improved means for protecting a flow of coating composition—such as a free-falling curtain or the flow on the slide surface of a slide hopper—from disturbance by ambient air currents that the present invention is directed.

SUMMARY OF THE INVENTION

In accordance with this invention, it has been found, most unexpectedly, that the disturbance of a flow of coating composition by ambient air currents can be eliminated, or at least substantially reduced, by the use of a protective shield formed of a foraminous material, such as screening or perforated plate material. The foraminous material functions to diffuse air currents impinging thereon so that their velocity is decreased, with a resulting decrease in their ability to disturb the flow of coating composition. The shield is designed to enclose the flow of coating composition to an extent sufficient to provide the desired degree of protection from disturbance. Optimum results are achieved with a shield formed of a plurality of spaced wall members, each of which is composed of a foraminous material.

In marked contrast to prior art shields utilized in coating operations, which have been constructed of imperforate materials, the foraminous shields disclosed herein are capable of diffusing and decelerating ambient air currents, rather than deflecting them, with resulting important advantages as hereinafter described in detail.

DESCRIPTION OF THE PREFERRED EMBODIMENTS

Figure 1:
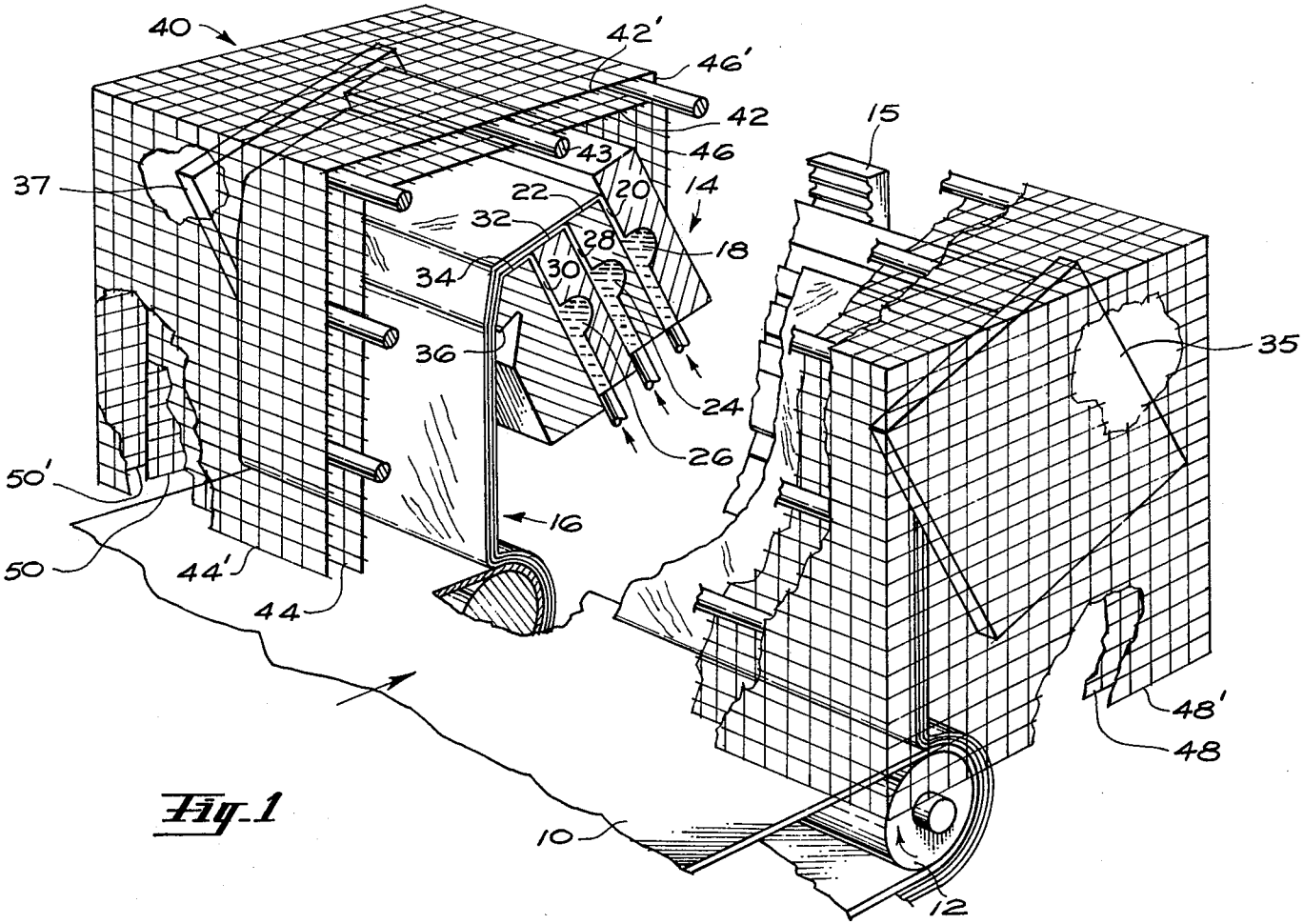
FIG. 1 is a perspective view, partly broken away and partly in section, of a multi-slide hopper functioning in a multi-layer curtain coating operation in which the coating zone is substantially enclosed within a foraminous shield structure in accordance with this invention.

The invention is described herein with particular reference to the coating of photographic materials. This field of coating involves highly precise operations in which disturbance of the flow of coating composition is a critical problem, so that the invention is especially beneficial in this field. However, the invention is in no way limited to use in the coating of photographic materials and can be advantageously employed in any method of coating, used in the manufacture of any product, wherein a flow of coating composition which is susceptible to disturbance by ambient air currents is generated.

The shield structure disclosed herein is highly effective in a typical production environment where air currents are generated by movement of personnel in the vicinity of the coating zone, by the opening and closing of doors, and so forth. While such currents do not appear to the casual observer to be very strong, they are of sufficient magnitude to greatly disturb a free-falling curtain of coating composition, especially where the curtain is wide, e.g., a meter or more, and of substantial height, e.g. ten centimeters or more. Such a curtain tends to act like a sail and can be easily moved by several centimeters or more from its intended path by the action of ambient air currents. Since high volume production operations can involve a curtain with a width of as much as two meters and a height of as much as fifty centimeters, the criticality of the problem will be readily appreciated.

It has been found that shield structures constructed of imperforate materials are generally ineffective in protecting a flow of coating composition from disturbance by ambient air currents and it is, accordingly, an important feature of this invention that the shield be formed from a foraminous material. While the reasons for this are not known with certainty, it is possibly explained by the fact that air currents which enter into, or are generated within, a shield structure of imperforate material are unable to pass through the walls of the structure and can be deflected back and forth between the walls to greatly disturb the coating operation. While a coating operation can be protected from air currents emanating from outside the coating zone by an imperforate shield structure that totally encloses the coating zone, such a structure is generally impractical. Since the object to be coated is advanced through the coating zone, there must be an entrance to and an exit from such zone for the moving object to enter and leave. Thus, it is not practical to completely seal off the coating zone from external air currents since they can penetrate the coating zone at such entrance or exit. Moreover, the object to be coated, such as a continuous web or a series of discrete sheets, is often advanced through the coating zone at very high speeds and the motion of the object is itself a potential source of air currents. If such currents are trapped within the shield structure and unable to dissipate, the risk of disturbance of the coating operation is obviously very great. With an imperforate shield structure which causes air currents to reverberate, the flow of coating composition can be subjected to disturbance as great or greater than when no shield is employed, whereas with a shield structure formed of a foraminous material, that is, a material that has many small openings, there is little or no tendency for air currents to reverberate. A shield structure formed of a foraminous material allows air currents emanating from outside the shield structure to be diffused and decelerated while at the same time allowing air currents emanating from within the shield structure to pass through. Accordingly, all sources of potential disturbance are effectively taken into account.

Figure 2:
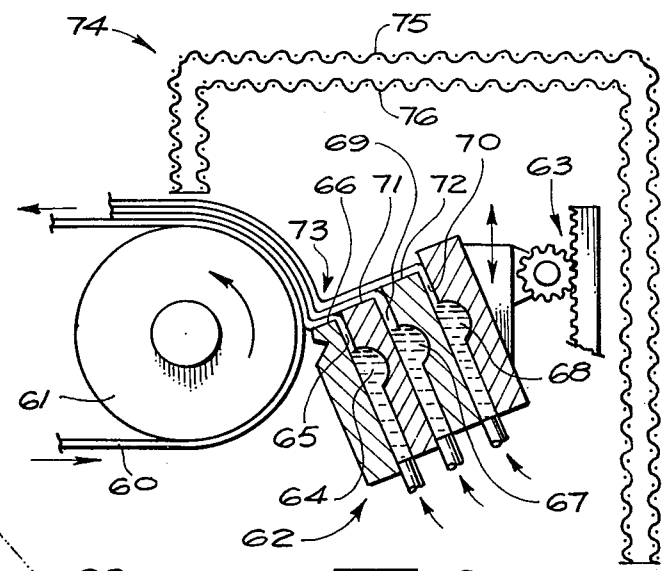
FIG. 2 is a side view, partly in elevation and partly in section, of a multi-slide hopper functioning in a multi-layer bead coating operation which is shielded by a foraminous shield structure similar to that shown in FIG. 1.

In certain embodiments of the present invention, the shield is constructed to surround the entire coating hopper, i.e., the shield structure substantially encloses the coating zone (see FIGS. 1 and 2). In other embodiments the shield structure does not surround the entire coating hopper but is designed to surround only the region where there is a flow of coating composition. Examples of the latter include a shield depending downwardly from a curtain coating hopper to enclose the free-falling curtain (see FIG. 3) and a shield which is pivotally attached to a slide hopper used for bead coating so that it can be swung into position to shield the coating composition flowing down the slide surface (see FIG. 4). In all instances, the shield structure encloses the flow of coating composition sufficiently to provide the desired protection from disturbance by ambient air currents.

While the main function of the foraminous shield of this invention is to protect the flow of coating composition from ambient air currents, it also serves to protect it from airborne contaminants, e.g., dirt particles, lint, and the like, which are large enough that they are unable to pass through the shield. Thus, it is usually advantageous for the shield structure to substantially enclose the entire coating zone, since it will then serve to keep such contaminants from contacting the coating hopper.

Bead coating and curtain coating are radically different methods of coating involving entirely different mechanisms, with the former involving extremely close spacing between the lip of the hopper and the object to be coated, such as a spacing of a few hundredths of a centimeter, and the latter involving a spacing which is hundreds or thousands of times as great. However, both of these methods, as well as other coating methods in which a flow of coating composition is generated by an applicator means, are capable of being dramatically improved in performance capabilities by use of the novel shield means of the present invention.

The geometry of the foraminous shield structure employed to protect a coating operation in accordance with this invention is a matter of design choice and can be varied widely to suit the specific parameters of the coating operation and the specific design of the coating hopper. One useful design is a box-like structure which substantially encloses the coating zone so that the coating hopper is positioned entirely within the shield structure. The box-like shield can be supported by brackets secured to the coating hopper or by an independent support structure. Other useful structures for enclosing the coating zone include a dome-shaped structure and a structure of pyramidal shape. In instances where the shield structure does not surround the coating hopper, but is designed to enclose only the flow of coating composition, a wide variety of designs is also feasible, and it is usually most expedient to support the shield by connection to the body of the coating hopper. An advantage of these designs is that the shield structure can be relatively small in size and of very simple construction.

The degree to which the shield structure encloses the flow of coating composition is a matter of design choice. It can totally or almost totally enclose the flow to provide a maximum degree of protection from disturbance. However, it is necessary only that it enclose the flow sufficiently to provide a useful degree of protection. Since air currents can emanate from almost any point in the coating environment, this will generally require that the shield structure substantially enclose the flow. Usually, it will be desirable to have the shield structure extend along both faces and over the top of a free-falling curtain of coating composition. However, if the walls of the shield structure extending along the faces of the curtain extend sufficiently above the point where free fall of the curtain begins, then it may not be necessary to have the shield extend over the top, since air currents that could cause disturbance will be effectively blocked without the need for a top. A further factor influencing design of the shield is the fact that air currents impinging on a free-falling curtain of coating composition near to the hopper lip are much more likely to cause disturbance of the curtain than air currents impinging on the curtain near the point where it contacts a moving web. As a result of this, it may be possible to provide adequate protection in a particular coating system with a shield which does not extend into close proximity to the moving web but rather terminates at a position well above the web surface. In certain instances, it may be feasible to have only about the upper half of the curtain within the enclosing shield structure.

Referring now to the drawings, there is shown in FIG. 1 a multi-slide hopper functioning in a multi-layer curtain coating operation is which the coating zone is substantially enclosed within a double-walled foraminous shield structure. The slide hopper is designed to simultaneously apply three layers of coating composition to the surface of a moving support in superposed distinct layer relationship. The support which is coated is a continuous web 10 which is advanced along a coating path by suitable web-driving means including a backing roll 12 which rigidly supports and smooths web 10 while also reversing its direction of travel. Located above the coating path is a triple-slide hopper 14 which forms a three-layer free-falling curtain 16 of coating composition which impinges on web 10 as it passes around backing roll 12, to thereby deposit on web 10 a coating composed of three distinct superposed layers.

Hopper 14 is equipped with rack-and-pinion 15 to permit precise adjustment of its height relative to the coating path. The coating composition intended to form the lowermost layer on web 10 is continuously pumped by a suitable metering pump (not shown) at an appropriate rate into cavity 18 from which it passes through slot 20 onto slide surface 22 down which it flows by gravity. In a similar manner, other coating compositions intended to form the layers above the lowermost layer are continuously pumped into cavities 24 and 26 and passed through slots 28 and 30, onto slide surfaces 32 and 34, respectively, down which they flow by gravity. Coating composition flowing down slide surfaces 22, 32 and 34 falls from lip 36 of coating hopper 14 as a three-layer free-falling curtain 16 which impinges on the surface of moving web 10. Coating hopper 14 is equipped with end plates 35 and 37 to restrain lateral flow of the coating compositions and free-falling curtain 16 is guided at each of its lateral edges by rigid edge guides (not shown) which serve to stabilize it and define its width.

To protect free-falling curtain 16 from disturbance by ambient air currents, coating hopper 14 is enclosed within shield structure 40 which functions to diffuse and decelerate air currents impinging thereon. Shield structure 40 is a box-like structure formed from fine-mesh metal screening. It is of double-walled construction such that the top section if formed of inner and outer walls 42 and 42', respectively, maintained in spaced parallel relationship by spacer rods 43. Similarily, the front section of shield structure 40 is made up of spaced walls 44 and 44', the back section of spaced walls 46 and 46', an end section of spaced walls 48 and 48', and the opposite end section of spaced walls 50 and 50'. Walls 44, 46, 48 and 50 are maintained in spaced parallel relationship with walls 44', 46', and 50', respectively, by spacer rods 43. Suitable supporting members (not shown) are provided to support shield structure 40 and secure it in its proper position with front wall 44 spaced a short distance from the face of free-falling curtain 16 and terminating a short distance above the surface of moving web 10.

FIG. 2 illustrates a multi-slide hopper which is functioning in a multi-layer bead coating operation and which is substantially enclosed within a double-walled foraminous shield structure. As shown in FIG. 2, continuous web 60 is advanced around backing roll 61 and passes closely adjacent to triple-slide hopper 62 which applies to web 60 a coating composed of three distinct layers. Hopper 62 is equipped with rack-and-pinion 63 permit precise adjustment of its position in relation to backing roll 61. The coating composition intended to form the lowermost layer on web 60 is continuously pumped by a suitable metering pump (not shown) at an appropriate rate into cavity 64, from which it passes through slot 65 onto slide surface 66 down which it flows by gravity. In a similar manner, other coating compositions intended to form the layers above the lowermost layer are continuously pumped into cavities 67 and 68 and passed through slots 69 and 70, respectively, onto slide surfaces 71 and 72, respectively, down which they flow by gravity. The layers of coating composition flowing down slide surfaces 66, 71, and 72 flow into coating bead 73 and as moving web 60, passing around backing roll 61, moves across and in contact with coating bead 73, it picks up the three layers of coating composition. To protect coating composition flowing on slide surfaces 66, 71 and 72 from disturbance by ambient air currents, coating hopper 62 is enclosed within shield structure 74, which is constructed of fine-mesh metal screening and is of double-walled construction, such that outer screen 75 and inner screen 76 are maintained in spaced parallel relationship.

Figure 3:
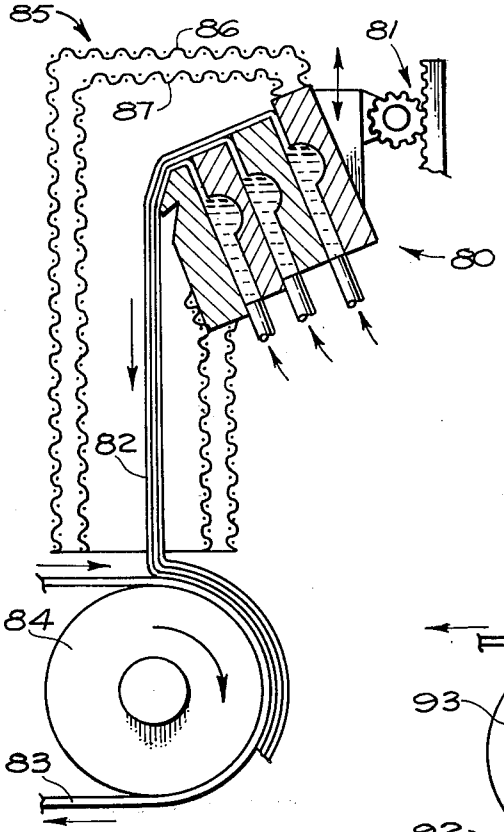
FIG. 3 is a side view, partly in elevation and partly in section, of a multi-slide hopper, functioning in a multi-layer curtain coating operation, which is equipped with a foraminous shield structure that is affixed to the body of the hopper.

FIG. 3 illustrates a multi-slide hopper which is functioning in a multi-layer curtain coating operation and in which the shielf structure encloses only the free-falling curtain rather than enclosing the entire coating hopper. In this embodiment, hopper 80 equipped with rack-and-pinion 81, generates free-falling curtain 82 which impinges on moving web 83 as it passes around backing roll 84. Double-walled foraminous shield structure 85, constructed of fine mesh metal screening and affixed to the body of hopper 80 comprises outer screen 86 and inner screen 87 which are maintained in spaced parallel relationship.

Figure 4:
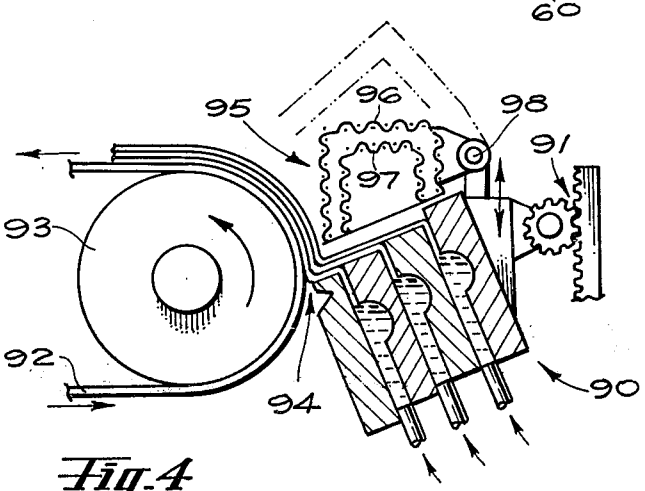
FIG. 4 is a side view, partly in elevation and partly in section, of a multi-slide hopper, functioning in a multi-layer bead coating operation, which is equipped with a foraminous shield structure that is affixed to the body of the hopper.

FIG. 4 illustrates a multi-slide hopper which is functioning in a multi-layer bead coating operation and in which the shield structure encloses only the region surrounding the slide surfaces rather than enclosing the entire coating hopper. In this embodiment, hopper 90, equipped with rack-and-pinion 91, is positioned closely adjacent to moving web 92 passing around backing roll 93 so as to form coating bead 94. Double-walled foraminous shield structure 95, constructed of fine-mesh metal screening is comprised of outer screen 96 and inner screen 97 which are maintained in spaced parallel relationship. Shield structure 95 is pivotally affixed to the body of hopper 90 by pivoting means 98, so as to enable it to be swung into position to protect the flow of coating composition on the slide surfaces of hopper 90 during use and to be swung up and out of the way to provide access to hopper 90 for purposes such as cleaning and maintenance.

Any type of coating composition applicator means can be used in the present invention. Thus, for example, the coating device can be a bead coating hopper of the slide type or of the slide-extrusion type. Alternatively, it can be a curtain coating hopper of the overflow weir type, the pressure extrusion type, the slide type, or the slide-extrusion type. The coating device can be adapted to carry out single-layer coating or it can be of the type with which a plurality of layers are simultaneously coated. It can be designed for the coating of continuous webs or for the coating of discrete sheet materials which are advanced sequentially through the coating zone. It can be adapted to carry out full width coating or to carry out coating of abutting or non-abutting stripes as described, for example, in Research Disclosure, Item 17533, Volume 175, November, 1978.

The novel protective shield disclosed herein is especially advantageous for use in high speed curtain coating operations in which the curtain falls freely over a substantial distance, e.g., more than ten centimeters, since curtains of this type are very susceptible to disturbance by ambient air currents. It is particularly useful in curtain coating operations in which a continuous web passes around a backing roll and the free-falling curtain impinges on the web as it is supported by the backing roll. In such operations, the impingement point must be carefully controlled and can deviate from its optimum position only within a rather narrow range. Thus, it is critical that the curtain be protected from ambient air currents so that it is not displaced from its intended impingement point.

In the practice of this invention, the protective shield can be constructed of any foraminuous material, the orifices of which are of a size and spacing whereby ambient air currents impinging thereon are diffused and decelerated. Examples of useful foraminous materials include metal screening, perforated metal plates, plastic sheeting having a multiplicity of fine holes formed therein, perforated paper, netting such as nylon or other fabric netting stretched taut within a frame, and the like. Advantageously, the foraminuous material is a transparent material to facilitate visual observation of the flow of coating composition.

Preferably, all walls of the shield structure are formed of a foraminous material, e.g., with a box-like structure having a front, a back, a top and two end walls, it is desirable that all of them be composed of a foraminous material. However, useful results can be achieved with structures which comprise both foraminous elements and imperforate elements, e.g., the box-like structure could be constructed with the front, back and top formed from metal screening, and the end walls formed from imperforate plastic sheeting.

The foraminous shield structure of this invention can be made up of a single foraminous element, e.g., a screen or perforated plate, or of a plurality, i.e., two, three or more, of spaced foraminous elements positioned in relation to one another so as to leave a relatively narrow gap therebetween. In other words, the shield structure can be of single-walled construction or of multiple-walled construction, e.g., double-walled or triple-walled.

The foraminous shield structure described herein is advantageously employed in the coating of any type of coating composition, including aqueous compositions, organic solvent compositions and mixed aqueous-organic systems. While the foraminous shield is advantageous in a variety of methods of coating, it is particularly advantageous in curtain coating operations, especially those involving the coating of photographic materials. Curtain coating of photographic materials can be carried out as a single-layer coating method in accordance with the teachings of Greiller, U.S. Pat. No. 3,632,374, the disclosure of which is incorporated herein by reference, or as a multiple-layer coating method in accordance with the teachings of Hughes, U.S. Pat. No. 3,508,947, the disclosure of which is incorporated herein by reference.

Curtain coating hoppers employed in the practice of this invention are typically equipped with edge guides to guide the free-falling curtain and define its width. Useful edge-guiding methods include the use of edge guides which ride on the web, as described in the aforesaid patents to Greiller and Hughes, and the use of "liquid edge-guiding" techniques as described in Research Disclosure, Item 17553, Volume 175, November, 1978.

Factors affecting the performance of the foraminous shield structure of this invention include:

(1) the size of the perforations,
(2) the spacing of the perforations,
(3) the shape of the perforations, e.g., whether they are round, square, oval, etc,
(4) whether the structure is a single-wall or multi-wall structure,
(5) the distance between the walls where it is a multi-wall structure,
(6) whether or not the perforations are aligned when it is a multi-wall structure,
(7) the thickness of the foraminous material, and
(8) the distance between the flow of coating composition, e.g., a free-falling curtain, and the walls of the shield structure.

All of the above factors are matters of design choice and can be varied widely to achieve optimum results with a particular coating system.

Both the size and spacing of the perforations are very important features in determining the efficiency with which the foraminous shield structures of this invention operate. Very good results are typically obtained with perforations having a size in the range of from about 0.1 to about 5 millimeters, and more preferably in the range of from about 0.25 to about 1.25 millimeters, and with a spacing such that the percentage of open area is in the range of from about 20 to about 65 percent, and more preferably in the range of from about 30 to about 50 percent. (As used herein, size ranges specified for perforation size refer to the diameter of the perforation where it is circular and to the maximum dimension where it is of a shape other than circular. An alternative way of referring to percentage open area is by reference to the "solidity" of the shield, by which is meant the fraction of the total flow area blocked by the shield. For example, a solidity of 0.40 means 40% blocked and 60% open). In contrast with the size and spacing of the perforations, the shape of the perforations is not a particularly important parameter and, generally speaking, the perforations can be of any desired shape.

It is greatly preferred that the foraminous shield structure be a multi-walled structure, i.e., a structure with two, three or more walls. In general, the greater the number of walls the more efficient the structure. However, under typical conditions, a double-walled shield structure is so efficient that the added cost and complexity of constructing a triple-walled structure would not be justified even though the triple-walled structure would be somewhat more effective. There is usually little to be gained in terms of improved performance by having more than three walls. When two or more walls are used, the distance by which they are spaced from one another is an important design factor. Preferably, the walls are spaced apart a distance in the range of from about 0.5 to about 10 centimeters, and most preferably a distance in the range of from about 2 to about 3.5 centimeters. In multi-wall structures, the degree to which the perforations of one wall align with the perforations of an adjacent wall is also a design factor affecting the overall performance of the shield structure, and it is usually desirable that the perforations be positioned so that they are out of alignment with those of the adjacent wall. Construction of a type in which the spaced walls are parallel to one another is generally satisfactory, but they can also be positioned in a non-parallel relationship if desired.

In using multi-wall shield structures, it is sometimes advantageous for the structure to be designed so that the size of the perforations diminishes progressively, with the outermost wall having the largest perforations and the innermost wall, which is closest to the flow of coating composition, having the smallest perforations. For example, a multi-wall shield structure could be comprised to an outermost wall having perforations with a size of 1.5 millimeters, an intermediate wall having perforations with a size of 1 millimeter, and an innermost wall, which would be located closest to the flow of coating composition, having perforations with a size of 0.5 millimeters.

The thickness of the foraminous material from which the shield is formed is also a significant factor in determining operating efectiveness. Generally speaking, it is desirable that the foraminous material be as thin as is practical since, all other factors being equal, a thin material is more effective than a thick one in reducing turbulence. Good results are typically obtained using foraminous materials with a thickness of less than about 2 millimeters. Thus, whether the shield is constructed from a woven wire screen, in which the thickness is dependent on the diameter of the wire from which the screen is formed, or from a perforated plate material, it is usually advantageous for its thickness to be below the specified value of about 2 millimeters.

Perhaps the most important of all the design factors is the distance between the flow of coating composition and the nearest wall of the shield structure. Thus, it is desirable to so position the shield that the distance from the nearest wall to the flow of coating composition is such that the flow of coating composition wll be in the region where the air is most quiescent. The optimum spacing is determined by a number of factors, including the velocity of the air currents impinging on the shield structure, the size of the perforations, the number of walls, the percentage of open area, and so forth. Under typical conditions, good results ae obtained with a spacing in the range of from about 5 to about 60 centimeters, more preferably in the range of from about 15 to about 30 centimeters.

The use of foraminous shield structures, such as those formed from screens or perforated plates, in the coating art was heretofore unknown. However, the use of screens or perforated plates in modifying gas flow is well known. For example, they are used in the design of electrostatic precipitators, and in this art, they are referred to as "diffusion screens." Their primary purpose is to promote uniform distribution of air, or other gaseous medium, flowing within the ducts of an electrostatic precipitator. References describing the use of diffusion screens in electrostatic precipitators include the textbook "Industrial Electrostatic Precipitation" by H. J. White, published by Addison-Wesley Publishing Company, Inc., 1963, (see Chapter 8, Section 8.6, pages 262–272); "The Electrostatic Precipitator Manual," Chapter II, Section 8, copyright 1977 by The McIlvaine Company; and the textbook "Electrostatic Precipitation" by Sabert Oglesby, Jr. and Grady B. Nichols, published by Marcel Dekker, Inc., New York, N.Y., 1978 (see Chapter 11, Section 11.3, pages 250–255). Screens or perforated plates are also used to reduce turbulence in aerodynamic wind tunnels, as described, for example, in an article entitled, "The Use of Damping Screens For the Reduction of Wind-Tunnel Turbulence," by H. L. Dryden and G. B. Schubauer, Journal Of The Aeronautical Sciences, Vol. 14, No. 4, pages 221–228, April, 1947. Use of screens or perforated plates as components of ventilation systems is also well known and is described in numerous patents such as, for example, in U.S. Pat. Nos. 4,023,472, 4,061,082, and 4,170,930.

The mechanisms whereby the foraminous shield structures of the present invention function to protect a coating operation are not known with certainty. It is believed that they are generally similar to those involved in the uses of screens and perforated plates discussed above so that many of the same design criteria would likely apply. There are many significant differences, however. For example, in the electrostatic precipitation art and in the wind tunnel art, the diffusion screens function to modify air flow characteristics within the confined area of a duct or tunnel, whereas the shield structures of the present invention are functioning to control ambient air currents. As a further example, electrostatic precipitators and wind tunnels involve very high mass flow rates of air, or other gaseous medium, as contrasted with the almost imperceptible flow of air involved in ambient currents that are capable of disturbing coating operations.

The foraminous shield structure described herein is very effective in protecting both curtain coating and bead coating operations from disturbance by ambient air currents It is markedly superior to shield structures constructed of imperforate materials in that such shield structures deflect air currents rather than diffuse them and, in consequence, reverberating air currents can be created. It is also advantageous in that there is little tendency for water vapor in the air to condense on a foraminous shield, whereas condensation of water vapor on an imperforate shield, with a resulting tendency for water to drip from the shield and damage the coating apparatus and/or the coated product, is a major problem.

Techniques for promoting wetting of the surface of a moving web by a liquid coating comosition and/or for reducing the thickness of the "barrier layer" of air carried by a moving web which are described in the aforesaid Greiller and Hughes patents can be advantageously employed in conjunction with the use of the foraminous shield structure described herein. Such techniques include prewetting of the support, the use of imperforate shields which extend into close proximity with the surface of the moving web, and the use of vacuum to draw off air within the barrier layer. Techniques involving the use of electrostatic polar charge to promote uniform coating can also be advantageously employed in conjunction with the use of a foraminous shield structure. Such use of electrostatic polar charge is well known and is described, for example, in U.S. Pat. Nos. 2,952,559 and 3,206,323.

In coating methods to which the present invention pertains the object to be coated is advanced along a path through a coating zone and the coating composition applicator means is positioned within the coating zone adjacent to the path. However, the specific relationship between the coating composition applicator means, e.g., a coating hopper, and the path along which the object to be coated is designed to travel is dependent upon the particular method of coating involved. Thus, for example, in curtain coating, the coating hopper is always positioned above the path, but the distance above can vary greatly such as from a narrow spacing of a few centimeters to a very wide spacing of as much as about 50 centimeters or more. On the other hand, in bead coating operations, a variety of orientations of hopper position in relation to path of travel of a web to be coated are feasible, but the spacing between the web and the lip of the hopper is typically only a few hundredths of a centimeter. Thus, reference herein to the applicator means as being "adjacent" to the path of travel of the object to be coated is intended to include any operative spacing whether it is large or small.

In order to evaluate the performance of the foraminous shield structure of this invention, the following tests were carried out:

Test 1

(a) A single-layer free-falling curtain, formed from glycerin with a surfactant added, undergoing a free-fall of 50 centimeters from the lip of a slide hopper to the surface of a stationary coating roll, was subjected to an air current impinging on the free-falling curtain near the hopper lip at a constant velocity of 75 cm/sec. As a result of the air current, the curtain was displaced by approximately 15 centimeters at the surface of the coating roll.

(b) Curtain movement was significantly affected by the vertical position of the source of the air current, with curtain movement becoming more severe as the source was raised closer to the lip of the hopper.

(c) Movement of personnel in the immediate vicinity of the coating hopper tended to draw the curtain off the coating roll.

(d) Opening and closing the door to the coating room caused severe curtain movement.

Test 2

(a) The coating hopper employed in Test 1 was enclosed within a box-like double-walled foraminous shield structure having walls formed of screen material spaced 0.6 centimeters apart. The screen material was a 24×24 mesh stainless steel screen, formed from 30 gage wire, having perforations of approximately 0.6 millimeters in size and a percentage open area of about 44 percent. The shield structure was constructed with front, back and top walls formed from the screen material and end plates formed from imperforate transparent plastic sheeting. The shield structure was positioned so that the front wall was spaced approximately 12.5 centimeters from the free-falling curtain, while both the back and top walls were spaced approximately 30 centimeters from the free-falling curtain.

(b) An air current having a velocity of 75 cm/sec. was directed at the shield structure, which functioned to slow the current to a velocity of 25 cm/sec.

(c) Movement of personnel in the immediate vicinity of the coating hopper caused some curtain movement but did not draw the curtain off the coating roll.

(d) Opening and closing the door to the coating room caused some curtain movement, in part as a result of insufficient rigidity of the shield structure which tended to move back and forth with the air currents.

Test 3

(a) The coating hopper employed in Tests 1 and 2 was enclosed within a box-like double-walled foraminous shield structure constructed in the same manner as that described in Test 2, except that the screens were spaced 2.5 centimeters apart and the structure was made more rigid by the use of spacer rods. The shield structure was maintained in the same position with relation to spacing from the free-falling curtain as in Test 2.

(b) The shield structure was observed to reduce the velocity of an air current impinging thereon from 150 cm/sec. to 7 cm/sec.

(c) Movement of personnel in the immediate vicinity of the coating hopper caused slight curtain movement.

(d) Opening and closing the door to the coating room caused no observable curtain movement.

Test 4

This test differed from Test 3 only in that the front wall of the shield structure was spaced approximately 30 centimeters from the free-falling curtain, while spacing of the back and top walls was the same as in Test 3. Under these conditions, neither a 150 cm/sec. air current, nor movement of personnel, nor opening and closing of the door to the coating room caused any observable curtain movement.

The invention has been described in detail with particular reference to preferred embodiments thereof, but it will be understood that variations and modifications can be effected within the spirit and scope of the invention.

I claim:

1. Coating apparatus comprising:
means for advancing an object to be coated,
means for forming a flow of coating composition for application to said advancing object, and
shield means formed of a foraminous material for protecting said flow of coating composition from disturbance by ambient air currents.

2. Coating apparatus comprising:
means for advancing an object to be coated along a path through a coating zone,
coating composition applicator means positioned within said coating zone adjacent to said path for forming a flow of coating composition that is applied to said advancing object, and
shield means formed of a foraminous material enclosing said flow of coating composition sufficiently to protect it from disturbance by ambient air currents, said foraminous material functioning to diffuse air currents impinging thereon so that their velocity is decreased, thereby diminishing their ability to disturb said flow of coating composition.

3. Web coating apparatus comprising:
means for advancing a web along a path through a coating zone,
coating composition applicator means positioned within said coating zone adjacent to said path for forming a flow of coating composition that is applied to said advancing web, and
shield means enclosing said flow of coating composition sufficiently to protect it from disturbance by ambient air currents, said shield means comprising a plurality of spaced elements of a foraminous material, said foraminous material functioning to diffuse air currents impinging thereon so that their velocity is decreased, thereby diminishing their ability to disturb said flow of coating composition.

4. Curtain coating apparatus comprising:
means for advancing an object to be coated along a path through a coating zone,
a curtain coating hopper positioned within said coating zone above said path for forming a free-falling curtain of coating composition which extends transversely of said path and impinges on said advancing object, and
shield means enclosing said free-falling curtain sufficiently to protect it from disturbance by ambient air currents, said shield means comprising a plurality of spaced elements of a foraminous material, said foraminous material functioning to diffuse air currents impinging thereon so that their velocity is decreased, thereby diminishing their ability to disturb said free-falling curtain.

5. Curtain coating apparatus comprising:
means for advancing a web along a path through a coating zone, a curtain coating hopper positioned within said coating zone above said path for forming a free-falling curtain of coating composition which extends transversely of said path and impinges on said advancing web, and shield means enclosing said free-falling curtain sufficiently to protect it from disturbance by ambient air currents, said shield means comprising a plurality of spaced elements of a foraminous material, said foraminous material functioning to diffuse air currents impinging thereon so that their velocity is decreased, thereby diminishing their ability to disturb said free-falling curtain.

6. Curtain coating apparatus comprising:

a coating roll, means for advancing a web along a path through a coating zone, said path extending partially around said coating roll, a curtain coating hopper positioned within said coating zone above said path for forming a free-falling curtain of coating composition which extends transversely of said path and impinges on said advancing web as it passes around said coating roll, and shield means enclosing said free-falling curtain sufficiently to protect it from disturbance by ambient air currents, said shield means comprising a plurality of spaced elements of a foraminous material, said foraminous material functioning to diffuse air currents impinging thereon so that their velocity is decreased, thereby diminishing their ability to disturb said free-falling curtain.

7. Bead coating apparatus comprising:

means for advancing a web along a path through a coating zone, a bead coating hopper positioned within said coating zone adjacent to said path for forming a flow of coating composition that establishes a coating bead which is maintained in bridging relationship between said hopper and a surface of said web, whereby movement of said web across and in contact with said coating bead deposits a layer of coating composition on said web, and, shield means enclosing said flow of coating composition sufficiently to protect it from disturbance by ambient air currents, said shield means comprising a plurality of spaced elements of a foraminous material, said foraminous material functioning to diffuse air currents impinging thereon so that their velocity is decreased, thereby diminishing their ability to disturb said flow of coating composition.

8. Multi-layer curtain coating apparatus comprising:

means for advancing a web along a path through a coating zone, a multiple-slide hopper positioned within said coating zone above said path for forming a free-falling multi-layer curtain of coating composition which extends transversely of said path and impinges on said advancing web, and shield means enclosing said free-falling curtain sufficiently to protect it from disturbance by ambient air currents, said shield means comprising a plurality of spaced elements of a foraminous material, said foraminous material functioning to diffuse air currents impinging thereon so that their velocity is decreased, thereby diminishing their ability to disturb said free-falling curtain.

9. Multi-layer bead coating apparatus comprising:

means for advancing a web along a path through a coating zone, a multiple-slide hopper positioned within said coating zone adjacent to said path for forming a coating bead from a plurality of flowing layers of coating compositions, said bead being maintained in bridging relationship between said hopper and a surface of said web, whereby movement of said web across and in contact with said bead deposits a plurality of distinct layers of coating compositions on said web, and shield means enclosing said flowing layers sufficiently to protect them from disturbance by ambient air currents, said shield means comprising a plurality of spaced elements of a foraminous material, said foraminous material functioning to diffuse air currents impinging thereon so that their velocity is decreased, thereby diminishing their ability to disturb said flowing layers.

10. Coating apparatus as claimed in claim 2 wherein said shield means is a single-walled structure.

11. Coating apparatus as claimed in claim 2 wherein said shield means is a multi-walled structure, each wall of which is comprised of a foraminous material.

12. Coating apparatus as claimed in claim 2 wherein said shield means is a double-walled box-like structure.

13. Coating apparatus as claimed in claim 2 wherein said shield means is composed of screen material.

14. Coating apparatus as claimed in claim 2 wherein said shield means is composed of perforated plate material.

15. Coating apparatus as claimed in claim 2 wherein said shield means is composed of foraminous material having perforations with a size in the range of from about 0.25 to about 1.25 millimeters and a percentage open area in the range of from about 30 to about 50 percent.

16. Coating apparatus comprising:

means for advancing an object to be coated along a path through a coating zone, coating composition applicator means positioned within said coating zone adjacent to said path for forming a flow of coating composition that is applied to said advancing object, and shield means formed of a foraminous material substantially enclosing said coating zone for protecting said flow of coating composition from disturbance by ambient air currents.

17. Coating apparatus comprising:

means for advancing an object to be coated along a path through a coating zone, coating composition applicator means positioned within said coating zone adjacent to said path for forming a flow of coating composition that is applied to said advancing object, and, a double-walled shield structure including a first wall, a second wall and means supporting said first and second walls in parallel spaced relationship, each of said first and second walls being formed of a foraminous material, said shield structure substantially enclosing said coating zone to protect said flow of coating composition from disturbance by ambient air currents.

18. A method of protecting a flow of coating composition from disturbance by ambient air currents during a process of coating, which method comprises interposing a shield formed of a foraminous material between said flow and the source of said air currents, said foraminous material functioning to diffuse air currents impinging thereon so that their velocity is decreased, thereby diminishing their ability to disturb said flow of coating composition.

19. A method as claimed in claim 18 wherein said shield is a multi-walled structure, each wall of which is comprised of a foraminous material.

20. A method as claimed in claim 18 wherein said shield is composed of screen material.

21. A method as claimed in claim 18 wherein said shield is composed of perforated plate material.

22. A method as claimed in claim 18 wherein said process is a multi-layer bead coating process.

23. A method as claimed in claim 18 wherein said process is a multi-layer curtain coating process.

24. A method as claimed in claim 18 wherein said coating composition is a photographic coating composition.

25. In a method of coating in which an object to be coated is advanced along a path through a coating zone and a flow of coating composition is applied to said advancing object within said coating zone, the improvement comprising shielding said flow of coating composition from disturbance by ambient air currents with a shield formed of a foraminous material, said foraminous material functioning to diffuse air currents impinging thereon so that their velocity is decreased, thereby diminishing their ability to disturb said flow of coating composition.

26. A method as claimed in claim 25 wherein said shield is a multi-walled structure, each wall of which is comprised of a foraminous material.

27. A method as claimed in claim 25 wherein said shield is composed of screen material.

28. A method as claimed in claim 25 wherein said shield is composed of perforated plate material.

29. A method as claimed in claim 25 wherein said object is a continuous web.

30. A method as claimed in claim 25 wherein said object is coated by a multi-layer bead coating process.

31. A method as claimed in claim 25 wherein said object is coated by a multi-layer curtain coating process.

32. A method as claimed in claim 25 wherein said coating composition is a photographic coating composition.

* * * * *